US007578080B2

(12) United States Patent
Stoetzer et al.

(10) Patent No.: US 7,578,080 B2
(45) Date of Patent: Aug. 25, 2009

(54) CUTTING TOOTH FOR A GROUND WORKING IMPLEMENT

(75) Inventors: Erwin Stoetzer, Aichach (DE); Wilhelm Ruby, Waidhofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 63 days.

(21) Appl. No.: 11/586,009

(22) Filed: Oct. 25, 2006

(65) Prior Publication Data

US 2007/0107273 A1 May 17, 2007

(30) Foreign Application Priority Data

Oct. 25, 2005 (EP) ..... 05023320

(51) Int. Cl.
*E02F 9/28* (2006.01)

(52) U.S. Cl. ..... 37/452; 37/455; 172/540; 299/101; 299/82.1; 299/83.1

(58) Field of Classification Search ..... 37/446, 37/452, 455, 460; 172/540, 554, 555; 299/101, 299/83.1, 82.1
See application file for complete search history.

(56) References Cited

U.S. PATENT DOCUMENTS

| | | | | |
|---|---|---|---|---|
| 2,118,878 | A * | 5/1938 | Bowman | 299/103 |
| 3,484,844 | A * | 12/1969 | Petersen | 37/457 |
| 3,720,273 | A | 3/1973 | McKenry et al. | |
| 3,737,199 | A | 6/1973 | Stephenson | |
| 3,834,764 | A | 9/1974 | Krekeler | |
| 4,349,232 | A * | 9/1982 | Braun et al. | 299/109 |
| 4,674,802 | A * | 6/1987 | McKenna et al. | 299/112 R |
| 4,768,297 | A * | 9/1988 | Rivard | 37/91 |
| 4,813,501 | A * | 3/1989 | Mills et al. | 175/335 |
| 4,998,574 | A * | 3/1991 | Beach et al. | 144/241 |
| 6,014,826 | A * | 1/2000 | Walgren et al. | 37/456 |
| 6,270,164 | B1 * | 8/2001 | Seitle et al. | 299/82.1 |
| 6,450,269 | B1 * | 9/2002 | Wentworth et al. | 175/61 |
| 6,698,477 | B1 * | 3/2004 | Bennington | 144/235 |
| 2006/0087169 | A1 | 4/2006 | Hesse et al. | |

FOREIGN PATENT DOCUMENTS

| | | | |
|---|---|---|---|
| DE | 29 50 108 | A1 | 6/1981 |
| DE | 35 32 389 | A1 | 4/1986 |
| DE | 86 11 538 | U1 | 7/1986 |
| DE | 86 25 465 | U1 | 12/1986 |
| DE | 35 16 332 | A1 | 1/1987 |
| DE | 87 15 141.3 | | 11/1987 |
| DE | 297 20 261 | U1 | 11/1997 |
| DE | 20 2004 005 920 | U1 | 7/2004 |
| GB | 1 228 009 | A | 4/1971 |

* cited by examiner

*Primary Examiner*—Thomas A Beach
*Assistant Examiner*—Matthew R Buck
(74) *Attorney, Agent, or Firm*—Jacobson Holman PLLC

(57) ABSTRACT

The invention relates to a cutting tooth for a ground working implement, particularly for a cutting wheel of a trench wall cutter, with a dedendum for reception in a holder of the ground working implement and at least one main cutting element for working the soil located at the top on the dedendum. For widening the working cross-section of the main cutting element at least one further reaming element is provided at the top on the dedendum and which, compared with the main cutting element, has a different cutting edge design.

11 Claims, 6 Drawing Sheets

CUTTING TOOTH FOR A GROUND WORKING IMPLEMENT

BACKGROUND OF THE INVENTION

1. Field of the Invention

The invention relates to a cutting tooth for a ground working implement, particularly for a cutting wheel of a trench wall cutter. Such a cutting tooth has a tooth root or dedendum for reception in a holder of the ground working implement and at least one main cutting element located on the top of the dedendum for working soil.

2. Related Art

Such cutting teeth are e.g. known from DE 297 20 261 U1 and DE 87 15 141 U1 and are used in underground working in trench wall cutters for producing trench walls. The cutting teeth can in particular be used in wheel cutters, where they are located on the circumferential surfaces of the cutting wheels. For producing a trench the cutting wheels are rotated and lowered into the ground. The cutting teeth break up and loosen the soil against the cutting wheels, so that it can e.g. be sucked off with the aid of a pump and/or can be processed to a suspension.

Ground working cutting wheels are frequently constructed in disk-like manner over a basic and in particular cylindrical wheel body, the disk axis coinciding with the cutting wheel rotation axis. The cutting teeth and optionally their holders are located in the disk areas of the cutting wheel. Between said disks fixed strippers placed on the cutting wheel frame can engage between the cutting teeth and optionally also their holders. During the cutting process the strippers form counterholders and give a firm resistance, so that on them it is also possible to break up harder rock material through the counterpressure of the moving cutting teeth.

The known cutting teeth have a shaft-like dedendum for reception in the cutting tooth holders. A carbide tip or cutting edge for cutting the soil is provided on an upper edge of the cutting tooth.

The width of the cutting tooth tip is more particularly chosen as a function of the ground to be worked. A narrower tip width is generally advantageous with harder rock material. By reducing the tip width and with an otherwise identical cutter design a higher superimposed load can be achieved, which increases the cutting progress, more particularly in hard rock. Thus, cutting teeth are known in which the cutting edge is narrower than the underlying front face of the dedendum.

In order in the case of such cutting teeth with a narrow tip width to prevent excessive wear to the comparatively wider tooth roots and optionally also the tooth holders, it is necessary to successively arrange several cutting teeth on a circumferential line of the cutting wheel in angularly adjusted manner. Thus, the tip-free dedendum sections and the holders are cut free by the circumferentially following cutting teeth. An alternating inclination of the cutting teeth by a few degrees to the side can also be necessary in order to cut free the stripper areas located between the cutting tooth-equipped disk areas. For the angular arrangement of the teeth the holders thereof can be laterally inclined on the cutting wheel circumference.

A laterally tilted arrangement of the individual cutting teeth on the cutting wheel makes it necessary to have different cutting tooth types on the same cutting wheel. Thus, each angular setting requires an individual cutting tooth type designed for said setting. Thus, with respect to the inclined holders it can be necessary for the carbide tip to be displaced to the right or left with respect to the cutting tooth centre, as a function of the tooth inclination, whereas with uninclined cutting teeth the tip is positioned centrally.

This makes it necessary to keep in stock a large number of cutting tooth designs on the building site in an uneconomic manner. The risk also exists that when replacing the cutting teeth a cutting tooth unsuitable for the given inclination is installed, which can lead to premature wear and increased costs for spares.

The object of the invention is to provide a particularly economically and universally usable cutting tooth, which is in particular suitable for harder rocks.

According to the invention the object is achieved by a cutting tooth characterized in that for widening the working cross-section of the main cutting element at least one further reaming element is provided on the dedendum at the top and which, compared with the main cutting element, has a different tip or cutting edge design.

It is a fundamental concept of the invention that the entire working width of the cutting tooth is not provided by a single cutting element and instead on the addendum several cutting elements are provided, which are mutually laterally displaced at right angles to the cutting direction. According to the invention several different cutting edge types are combined for removing soil over the entire working width. Tests have shown that with such a cutting edge design and when compared with known tooth types with a single cutting edge or tip, higher cutting speeds can be achieved in harder soils.

This observation is substantiated by the fact that the individual cutting elements do not break away the soil independently of one another. Thus, a main cutting element advancing in the cutting direction can weaken and therefore preloosen the rock structure also outside its geometrical cross-section. For the complete working of this preloosened rock by the reamers it is only necessary to have a comparatively low cutting capacity, which can be applied by the simply designed cutting elements.

Thus, according to the invention, it is e.g. possible to provide a cutting tooth with a narrower main cutting element relative to the holder and/or dedendum in order to be able to also work harder soils and achieve an adequate cutting progress. The main cutting element can e.g. be frontally and centrally fitted to the dedendum. In order to ensure the free cutting function of the tooth, according to the invention additional reamers are provided, which are in particular positioned symmetrically to the main cutting element. These reamers widen the total working cross-section of the cutting tooth. Thus, in the case of a small main cutting element and therefore good cutting progress a total cutting width can be achieved which exceeds the width of the dedendum and/or the holder thereof. Thus, with the inventive cutting teeth the holders and the stripper areas located between the cutting wheel disks can be reliably cut free with a good cutting progress without an inclination of the cutting teeth being required for this purpose.

Thus, the invention makes it possible for a considerable proportion of the tooth positions on the cutting wheel to provide only a single cutting tooth type, which greatly minimizes the spares storage costs and significantly reduces the risk of erroneous tooth installation. With one tooth the invention makes it possible to cover virtually the entire cutting disk.

For a particularly good cutting progress in the most varied soil geologies it is advantageous for the main cutting element to have at least one wedge-shaped cutting edge or tip. The cutting edge of the main cutting element then has a longitudinal extension and can be referred to as a linear cutting edge. A wedge-shaped cutting edge is very suitable for cutting in particular hard soils.

It is also advantageous for the reaming element to have at least one pin-type cutting edge. Such a pin-type cutting edge can in particular be conical, the cone e.g. having a round or oval base surface. A pin-type cutting edge is particularly suitable for the finished cutting of the soil already preloosened by the main cutting element. As a result of its small standing surface the provision of an additional pin-type cutting edge only slightly reduces the total contact pressure of the trench wall cutter, so that there is only a slight change to the cutting progress of the main cutting element. Furthermore pin-type cutting edges are comparatively inexpensive and require a comparatively small soldering area on the tooth root. The pin-type cutting edge can also be called a point cutting edge. It is generally advantageous for a good cutting progress for the main cutting element to have a more aggressive cutting edge compared with the reaming element.

Appropriately the two cutting elements are made from tungsten carbide and a less hard material can be used for the dedendum for economic reasons. In particular together with receptacles for the cutting elements, the dedendum is advantageously made from cast metal.

A particularly cost-effective and at the same time more efficient cutting tooth is obtained when the reaming element has a round shaft bit. Such a round shaft bit typically has a shaft and a larger cross-section head located thereon and on the end of which is provided a carbide pin. The round shaft bit can be constructed as a simple cutting pin.

According to a preferred embodiment of the invention it is advantageous to provide on the dedendum at least one reception sleeve, particularly with a circular or elliptical internal cross-section and in which is in preferably replaceable manner provided at least one reaming element. This leads to a particularly simply designed and universally usable cutting tooth.

According to the invention the main cutting element is oriented in a main cutting direction on the dedendum for soil removal purposes. The main cutting direction can also be called the cutting direction and is in particular that in which the cutting tooth moves tangentially as a result of the purely rotary movement of the cutting wheel. The cutting tooth advance direction, which particularly corresponds to the cutting wheel radial direction is perpendicular to the cutting direction. Appropriately the dedendum longitudinal axis is at least approximately parallel to the advance direction.

A particularly good cutting progress can be brought about in that the main cutting element is placed in leading manner on the dedendum compared with the reaming element in the main cutting direction. Advantageously the main cutting element is provided frontally on the dedendum on the face facing the soil. It can in particular at least zonally project in the main cutting direction over the end face of the dedendum. Appropriately the main cutting element is positioned upstream of a cutting edge support area located at the top on the dedendum and on which in turn are provided the reaming element and optionally its receptacle.

A particularly high contact pressure and therefore a particularly good cutting progress can be achieved in that the cutting width of the main cutting element is smaller than the dedendum width. The cutting width of the main cutting element can also vary over its height. The cutting width can in particular be understood to mean the size of the removal cross-section of the main cutting element perpendicular to the main cutting direction and perpendicular to the cutting tooth advance direction.

A further advantageous embodiment of the inventive cutting tooth is characterized in that, when considered in the main cutting direction, the reaming element projects laterally over the main cutting element and in particular over the dedendum. Preferably the reaming element projects on either side over the main cutting element or dedendum and for this purpose at least two reaming elements can be provided. Such an arrangement ensures a reliable free cutting of the dedendum and optionally gaps for stripper elements on the cutting wheel. The concept of lateral projection more particularly means a projection at right angles to the advance direction and/or the longitudinal axis of the dedendum.

A cutting tooth with a particularly reliable free cutting function is also obtained through the provision of at least two reaming elements. When considered in the main cutting direction, a reaming element is provided on either side of the main cutting element in each case. A cutting tooth particularly suitable for taking up the operating forces and which is therefore robust can be obtained in that the main cutting element, the reaming elements and in particular the dedendum are built up in mirror symmetrical manner. The symmetry plane is appropriately in the main cutting direction.

The cutting progress can be further improved in that the main cutting element has a longitudinal cutting edge running at right angles to the main cutting direction. Appropriately in V-shaped manner, two secondary cutting edges are connected to the longitudinal cutting edge. Whereas the longitudinal cutting edge appropriately runs roughly in the advance direction, the secondary cutting edges appropriately run at right angles to the advance direction from the cutting tooth centre to the longitudinal sides of the dedendum. Preferably two or more longitudinal cutting edges are provided in parallel.

The inventive cutting tooth can also be used as a hinged tooth which, as a function of the cutting wheel rotation angle, is tilted in order to cut free axially displaced soil areas. If the cutting tooth is to be used as a hinged tooth, it is advantageous for at least one reaming element, considered in the main cutting direction, to be located solely on one side of the main cutting element. Advantageously the reaming element is positioned in such a way that when the hinged tooth is tilted, i.e. when the longitudinal axis of the tooth diverges from the radial direction of the cutting wheel, it works the soil built up under said cutting wheel.

An inventive cutting tooth can also be used as a so-called sizing tooth, which is located on the axially outer disks of the cutting wheel, in order to cut free the outer area of the cutting wheel, i.e. its end faces. Here again the reaming element is preferably only located on one side with respect to the main cutting element. If the cutting tooth is to be used as a sizing tooth, appropriately at least one further cutting element is located on the dedendum on the cutting tooth side where the reaming element is also located. The further cutting element is preferably identical to the reaming element and in particular has a pin-type cutting edge. Appropriately the further cutting element is located on the dedendum below the reaming element. There are preferably several cutting elements in the dedendum longitudinal direction, which improves the cutting action in the outer area of the cutting wheel.

Particularly when used as a hinged tooth or sizing tooth, it is advantageous to laterally displace the longitudinal cutting edge with respect to a median plane of the dedendum, when considered in the main cutting direction. In the case of a sizing tooth the longitudinal cutting edge is appropriately displaced towards the reaming element and in the case of a hinged tooth away from said reaming element. Preferably in the case of a sizing tooth the longitudinal cutting edge is displaced towards the outer area of the cutting wheel.

Apart from the reaming element not provided there, the cutting wheels can be fundamentally constructed in the manner described in DE 297 20 261 U1 and DE 87 15 141 U1 and can be inserted into a cutting tooth holder as described in DE 87 15 141 U1. Apart from being usable on a wheel cutter, the inventive cutting teeth can also be used on a chain cutter. A trench wall cutter constructed for use of the inventive cutting teeth advantageously has two cutting wheel pairs, which are axially parallel on the underside of a frame.

BRIEF DESCRIPTION OF THE DRAWINGS

The invention is described in greater detail hereinafter relative to preferred embodiments and the attached diagrammatic drawings, wherein show.

Similarly acting elements are given the same reference numerals in all embodiments.

DETAILED DESCRIPTION OF THE PREFERRED EMBODIMENTS

Figure 1:
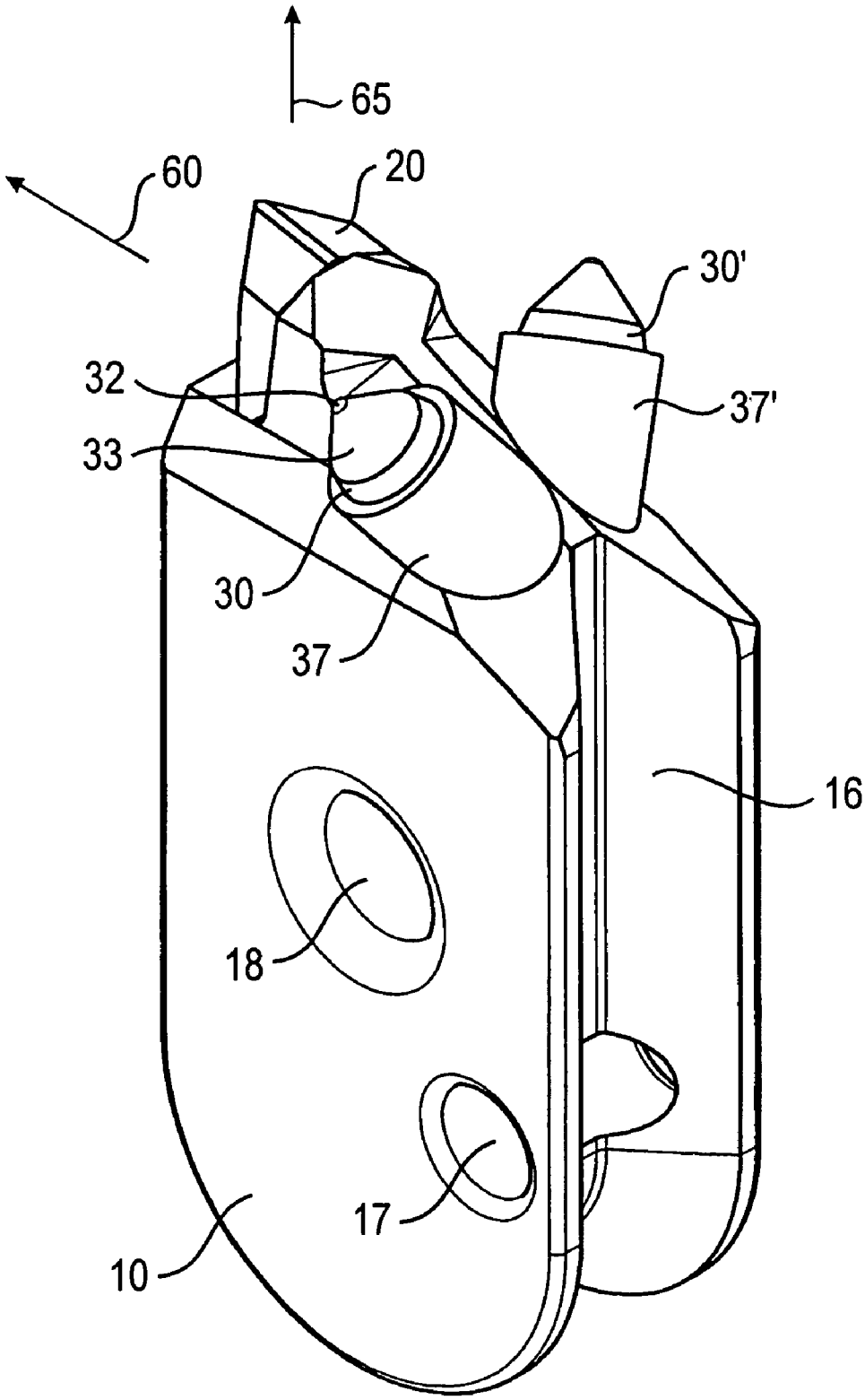
FIG. 1 A perspective view of a first embodiment of an inventive cutting tooth.
Figure 2:
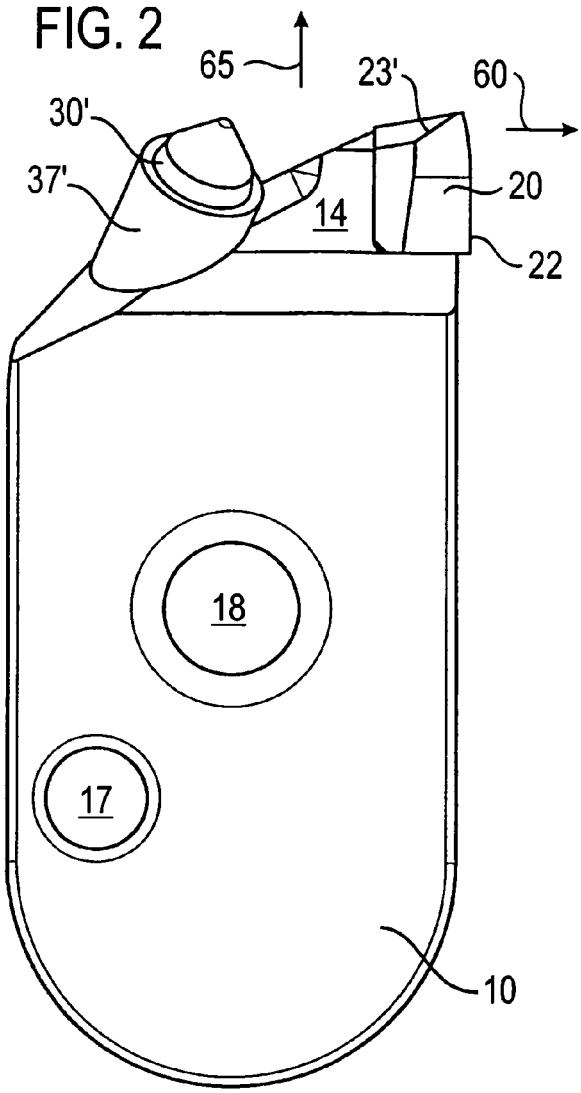
FIG. 2 A side view of the cutting tooth of FIG. 1.

FIGS. 1 to 4 show a first embodiment of a cutting tooth according to the invention. On its lower side, the cutting tooth has a dedendum 10 for reception in a cutting tooth holder. In the side view of FIG. 2 the dedendum 10 is U-shaped with two parallel front edges and a rounded base portion. On the two front faces of the cutting tooth, which are roughly radial when placed on the cutting wheel, as well as in the base area of the dedendum 10 is provided a longitudinal groove 16 with a substantially V-shaped cross-section. The longitudinal groove 16 forms part of a positive connection by means of which the cutting tooth is releasably fixed in the not shown cutting tooth holder.

The dedendum 10 also has a crosshole 17, which intersects both the longitudinal groove 16 and also the adjacent, solid part of dedendum 10. Crosshole 17 receives a shear pin in order to secure the cutting tooth 10 in the holder. On dedendum 10 is provided a further crosshole 18, which can be used for inserting a tool on extracting the cutting tooth from the holder.

For cutting operation the cutting tooth is inserted by means of its dedendum 10 in the cutting tooth holder on a cutting wheel. The cutting wheel is rotated about its cutting wheel axis, so that the cutting tooth is moved tangentially in a main cutting direction 60. Simultaneously the cutting wheel is introduced linearly into the ground, so that a cutting tooth movement takes place in the advance direction 65 perpendicular to the main cutting direction 60.

On the top of the dedendum 10 a main cutting element 20 made of carbide or hardened metal is provided. The main cutting element has a polyhedron-like construction and a wedge-shaped longitudinal cutting edge 22 extending perpendicular to the main cutting direction 60 roughly parallel to advance direction 65 and to the longitudinal axis of dedendum 10 upwards and away from the latter.

The main cutting element 20 is located frontally on the cutting tooth, the longitudinal cutting edge 22 projecting over the underlying end face of dedendum 10. On the top of the main cutting element 20 are provided two secondary cutting edges 23, 23', which branch off in V-shaped manner from the longitudinal cutting edge 22. The secondary cutting edges 23, 23' run outwards at right angles to the main cutting direction 60. On its rear side remote from the longitudinal cutting edge 22, the main cutting element 20 is supported by a cutting edge support area 14, whose height decreases with increasing spacing from the main cutting element 20.

Figure 4:
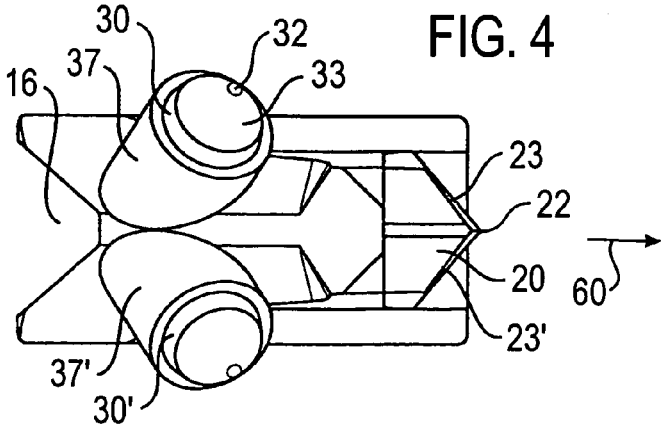
FIG. 4 A plan view of the cutting tooth of FIG. 1.
Figure 5:
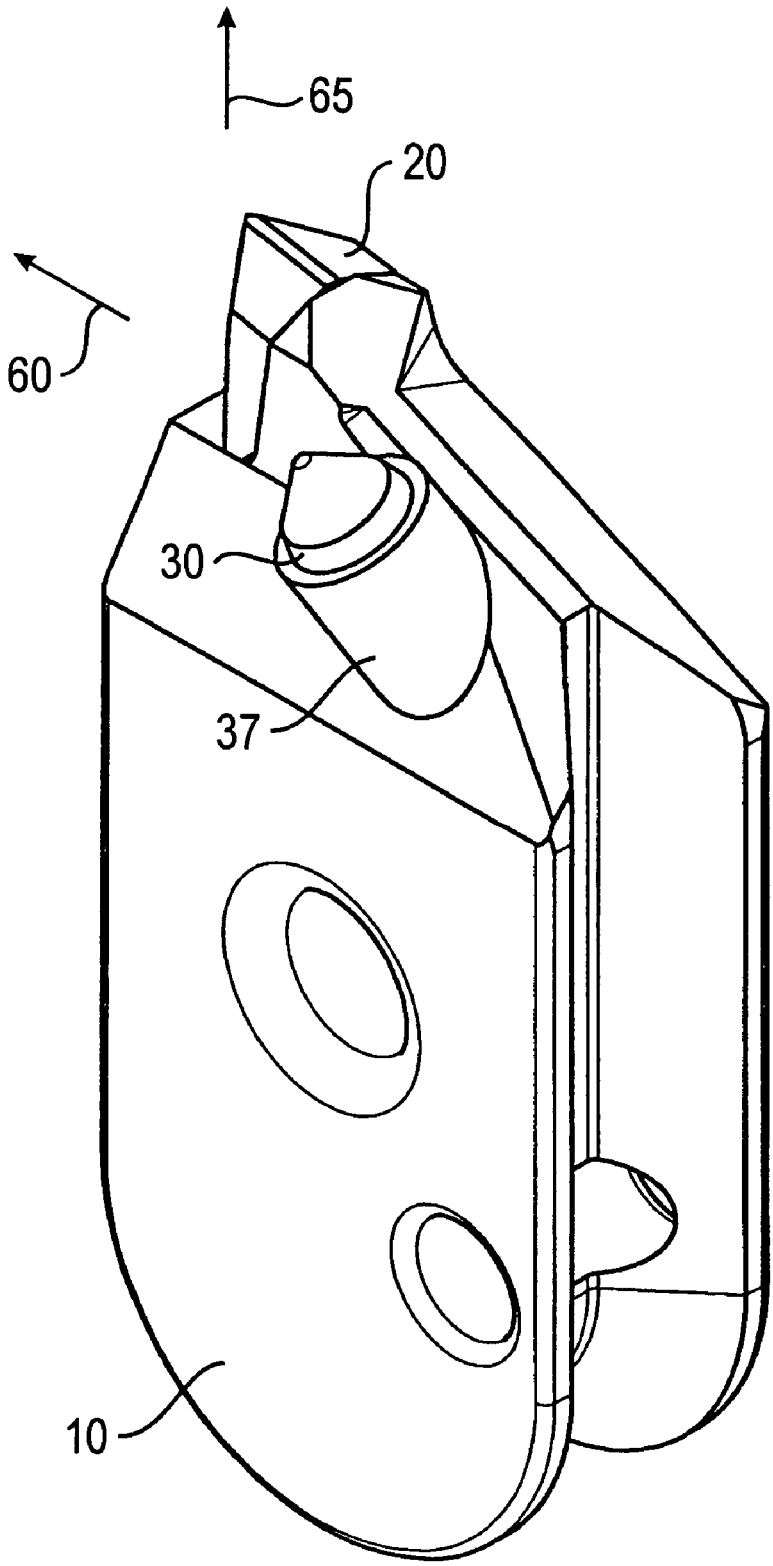
FIG. 5 Another embodiment of an inventive cutting tooth, constructed as a hinged tooth, in a perspective view.
Figure 6:
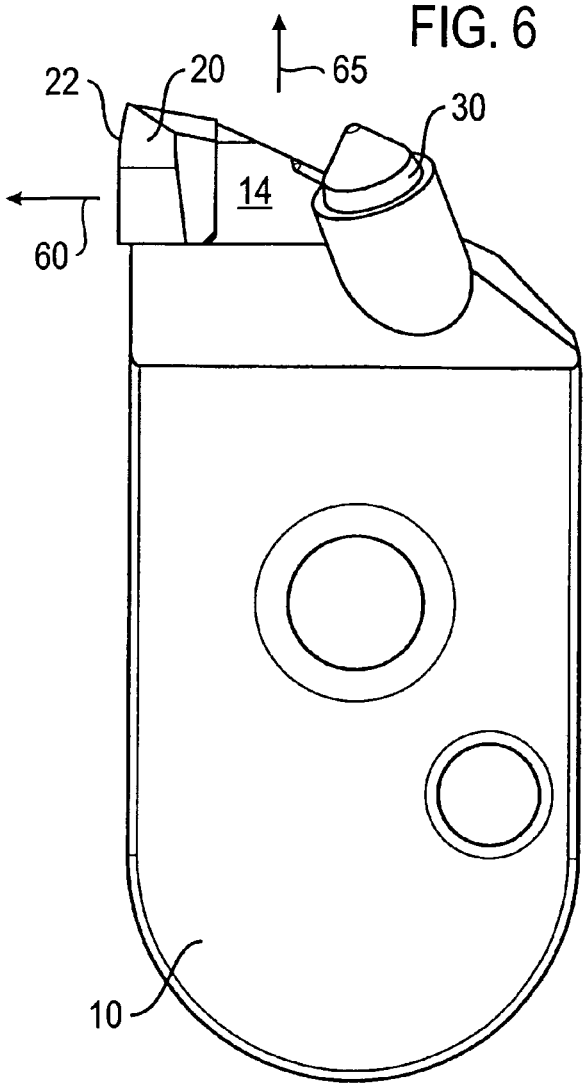
FIG. 6 A side view of the cutting tooth of FIG. 5.
Figure 7:
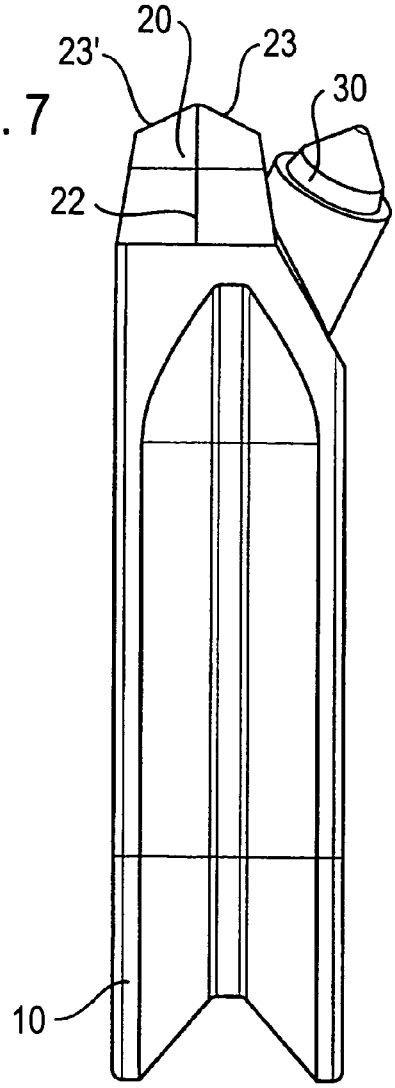
FIG. 7 A front view of the cutting tooth of FIG. 5.
Figure 8:
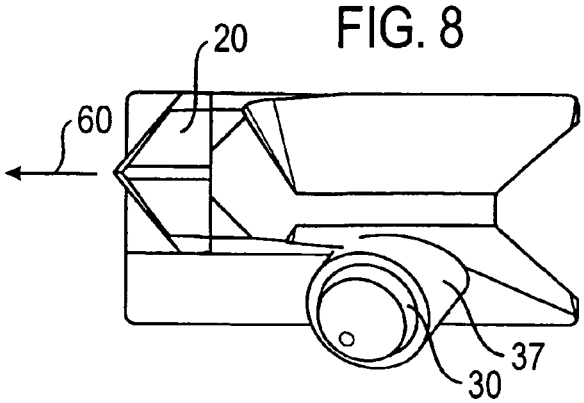
FIG. 8 A plan view of the cutting tooth of FIG. 5.
Figure 9:
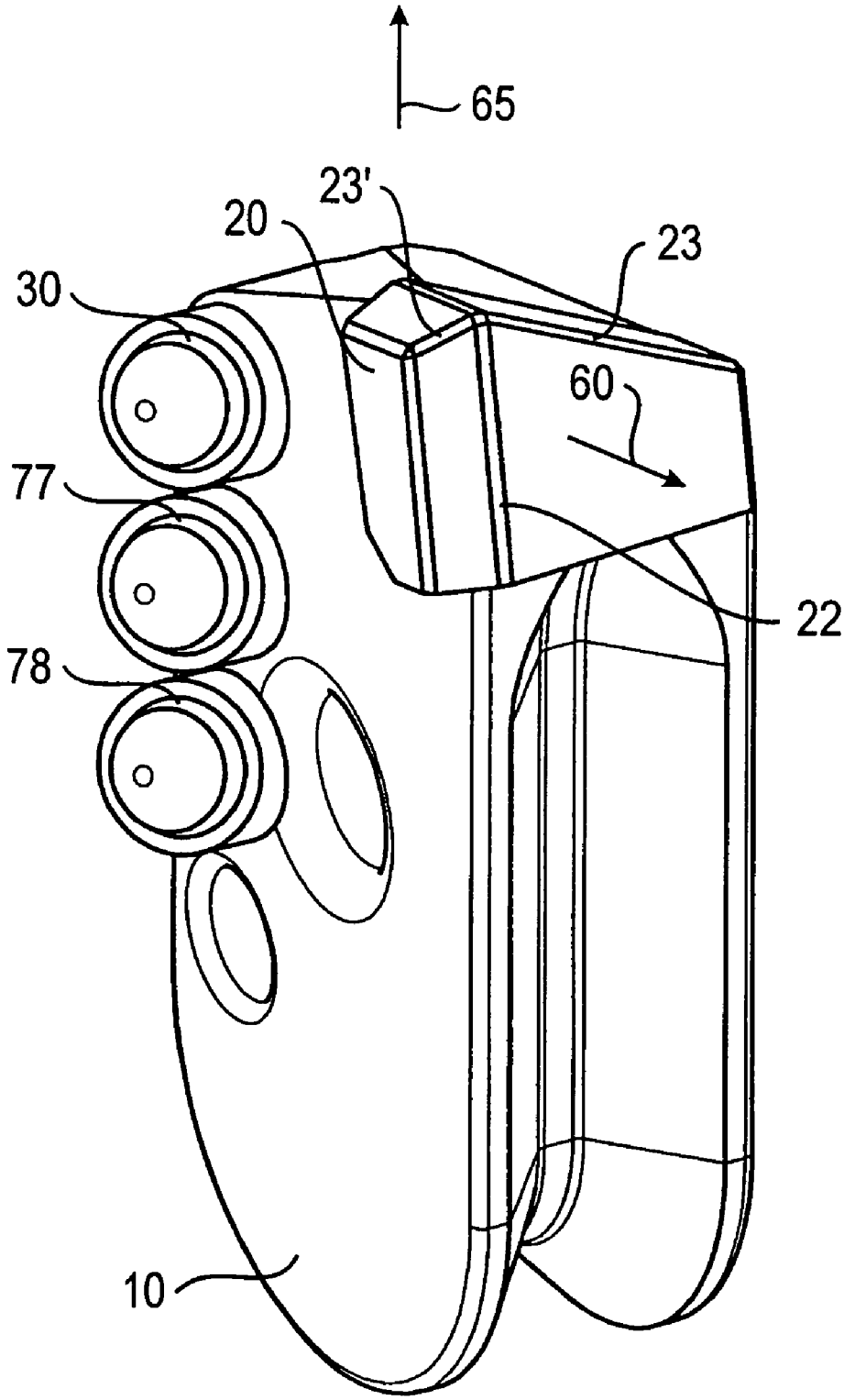
FIG. 9 Another embodiment of an inventive cutting tooth, constructed as a sizing tooth, in a perspective view.
Figure 10:
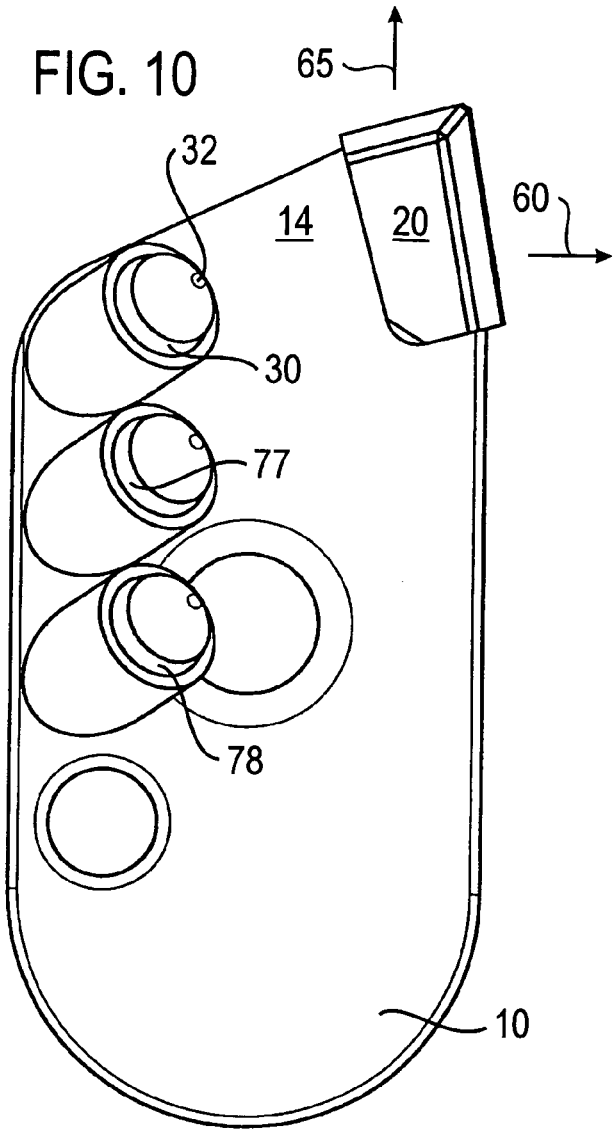
FIG. 10 A side view of the cutting tooth of FIG. 9.
Figure 11:
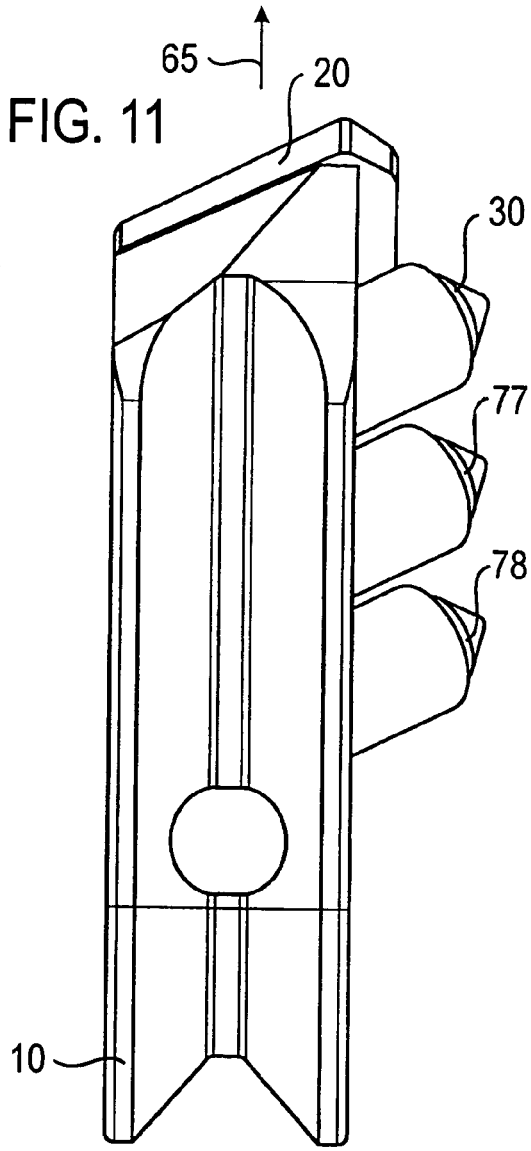
FIG. 11 A rear view of the cutting tooth of FIG. 9.
Figure 12:
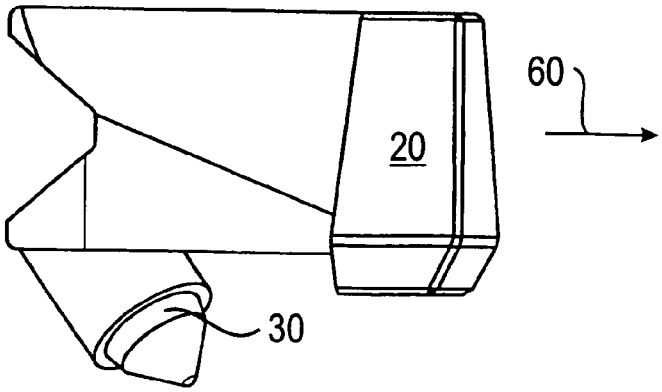
FIG. 12 A plan view of the cutting tooth of FIG. 9.

Behind the frontally positioned main cutting element 20, two reaming elements 30, 30' are provided on the top on dedendum 10. As shown in FIGS. 1 and 4 relative to the reaming element 30, reaming elements 30, 30' in each case have a round shaft bit 33 with a conical tip area. A conical, carbide pin-type cutting edge 32 is provided on the tip of the round shaft bit 33.

Two reception sleeves 37, 37' are provided in the rear portion of the cutting edge support area 14 on the top of dedendum 10 for holding the reaming elements 30, 30'. The round shaft bits 33 of the reaming elements 30, 30' are inserted in the reception sleeves 37, 37', which can in particular have a round or elliptical internal cross-section. The reaming elements 30, 30' are positioned in such a way that their pin-type cutting edges 32, considered in the main cutting direction 60, project laterally over the main cutting element 20, i.e. at right angles to advance direction 65, so that the entire removal cross-section of the cutting tooth is wider than the geometrical width of the main cutting element 20 and its secondary cutting edges 23, 23'. As can in particular be gathered from FIGS. 3 and 4, pin-type cutting edges 32 also project laterally over the dedendum 10, so that the reaming elements 30, 30' cut the entire width of the tooth free. In the advance direction 65 the pin-type cutting edge 32 and the upper end of longitudinal cutting edge 22, from which the secondary cutting edges 23, 23' emanate, are positioned roughly at the same level.

Reaming elements 30, 30' are positioned behind the main cutting element 20, i.e. the cutting edges 22, 23, 23' of main cutting element 20 are in advance of the pin-type cutting edges 32 of reaming elements 30, 30' in the main cutting direction 60.

The longitudinal axes of the round shaft bit 33 of the two reaming elements 30, 30' are roughly positioned in V-shaped manner relative to one another. The longitudinal axes are tilted with respect to advance direction 65 both in the main cutting direction 60 and also to the sides of the cutting tooth.

Figure 3:
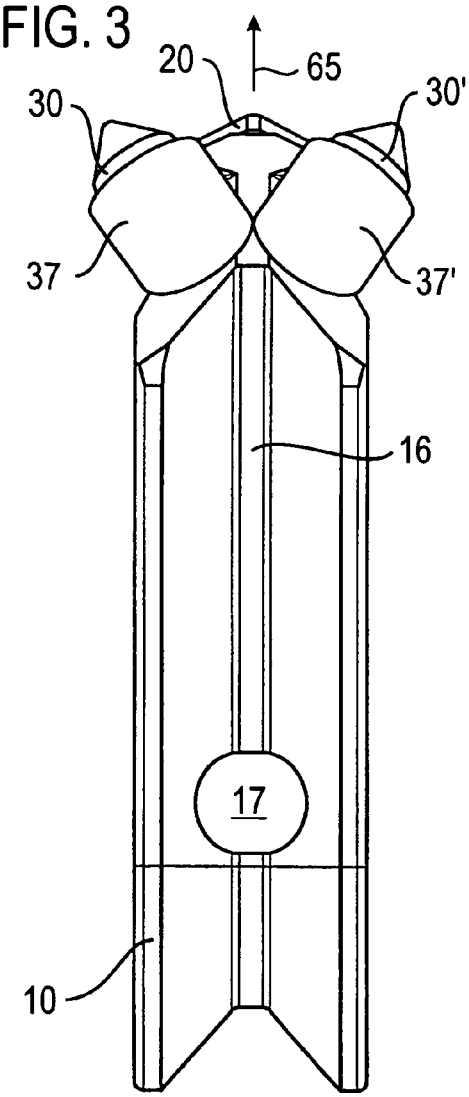
FIG. 3 A rear view of the cutting tooth of FIG. 1.

As can in particular be gathered from FIGS. 3 and 4, the main cutting element 20 is positioned centrally on the tooth face, the longitudinal cutting edge 22 being in the centre of the front face. The entire cutting tooth, including the main cutting element 20 and reaming elements 30, 30', is constructed in mirror symmetrical manner, the longitudinal cutting edge 22 of main cutting element 20 being in the plane of symmetry.

A further embodiment of an inventive cutting tooth, which can in particular be used as a hinged tooth, is shown in FIGS. 5 to 8. Dedendum 10 of said cutting tooth essentially corresponds to the tooth dedendum of FIGS. 1 to 4 and will not therefore be described again.

The cutting tooth shown in FIGS. 5 to 8 differs from the previously described cutting tooth essentially in that the main cutting element 20 is positioned in laterally displaced instead of central manner on the cutting tooth face. Unlike in the previously described cutting tooth, in the embodiment of FIGS. 5 to 8 a reaming element 30 is only provided on one side of the main cutting element 20. The reaming element 30 is positioned on that side of dedendum 10 from which the main cutting element 20 is displaced away from the tooth centre.

Admittedly, in itself the main cutting element 20 has mirror symmetry, but as a result of the displacement of the main cutting element 20 and the solely unilateral arrangement of the reaming element 30, the overall cutting tooth is not mirror symmetrical.

A further embodiment of an inventive cutting tooth, which can in particular be used as a sizing tooth, is shown in FIGS. 9 to 12. Dedendum 10 of said tooth once again essentially corresponds to the cutting tooth dedendum 10 of FIGS. 1 to 4 and will not be described again.

Unlike in the previously described cutting teeth, the main cutting element 20 of the embodiment of FIGS. 9 to 12 has a width at right angles to the main cutting direction 60 which exceeds the width of dedendum 10, i.e. the main cutting element 20 unilaterally projects laterally over the dedendum 10. The longitudinal cutting edge 22 is arranged in eccentrically displaced manner in the direction of the lateral projection on main cutting element 20.

In the embodiment of FIGS. 9 to 12, once again there is only a single reaming element 30 which, considered in the main cutting direction 60, is on the side of the cutting tooth where the main cutting element 20 projects over the dedendum 10.

Relative to the advance direction 65, the pin-type cutting edge 32 of reaming element 30 is roughly at the same height as main cutting element 20. Below the reaming element 30 and laterally on dedendum 10 there are two further cutting elements 77, 78, which once again have round shaft bits. The longitudinal axes of the round shaft bits of the further cutting elements 77, 78 are roughly parallel to the longitudinal axis of the round shaft bit of reaming element 30, but can also be mutually displaced in the main cutting direction 60.

The main cutting elements 20 of the embodiments of FIGS. 5 to 12 in each case terminate roughly flush with the underlying flanks of the tooth roots 10 on their longitudinal sides remote from the reaming elements 30.

The invention claimed is:

1. Cutting tooth for a cutting wheel of a trench wall cutter, the cutting wheel having a holder, the cutting tooth comprising:

a dedendum for reception in the holder of the cutting wheel, the dedendum having a top, a longitudinal axis, and an advance direction approximately parallel to the longitudinal axis, at least one main cutting element located at the top of the dedendum, the at least one main cutting element having a main cutting direction perpendicular to the longitudinal axis of the dedendum and having at least one wedge-shaped cutting edge, wherein the cutting edge extends substantially perpendicular to the main cutting direction and roughly parallel to the longitudinal axis of the dedendum, at least one reaming element located laterally on the dedendum, the at least one reaming element having a pin-type cutting edge and being configured for widening the working cross-section of the main cutting element, wherein with reference to the main cutting direction, the at least one reaming element projects laterally over the main cutting element and over the dedendum, and at least one further cutting element located laterally on the dedendum, on the same side as the at least one reaming element, and below the at least one reaming element, when seen in the advance direction of the dedendum, the at least one further cutting element having a pin-type cutting edge;

wherein the at least one main cutting element is arranged in a leading manner relative to the at least one reaming element in the main cutting direction on the dedendum;

wherein:

the at least one main cutting element has at least one longitudinal cutting edge at right angles to the main cutting direction;

the cutting tooth further comprises two secondary cutting edges connected in V-shaped manner to the at least one longitudinal cutting edge; and when considered in the main cutting direction, the longitudinal cutting edge is laterally displaced relative to a median plane of the dedendum in a direction towards the reaming element.

2. Cutting tooth according to claim 1, wherein the at least one reaming element has a round shaft bit.

3. Cutting tooth according to claim 1, further comprising at least one reception sleeve provided on the dedendum, and having a corresponding reaming element replaceably provided therein.

4. Cutting tooth according to claim 3, wherein the at least one reception sleeve has a circular internal cross-section.

5. Cutting tooth according to claim 3, wherein the at least one reception sleeve has an oval internal cross-section.

6. Cutting tooth according to claim 1, wherein the cutting width of the at least one main cutting element is smaller than the width of the dedendum.

7. Cutting tooth according to claim 1, wherein the at least one reaming element and the at least one further cutting element both have round shaft bits, each round shaft bit having a longitudinal axis, and wherein the longitudinal axis of the round shaft bit of the at least one further cutting element is parallel to the longitudinal axis of the round shaft bit of the at least one reaming element.

8. Cutting tooth according to claim 1, wherein in a direction relative to the advance direction, the pin-type cutting edge of the at least one reaming element, is approximately at the same height as the main cutting element.

9. Cutting tooth according to claim 1, wherein there are two further cutting elements.

10. Cutting tooth for a cutting wheel of a trench wall cutter, the cutting wheel having a holder, the cutting tooth comprising:

a dedendum for reception in the holder of the cutting wheel, the dedendum having a top, a longitudinal axis, and an advance direction approximately parallel to the longitudinal axis, at least one main cutting element located at the top of the dedendum, the at least one main cutting element having a main cutting direction perpendicular to the longitudinal axis of the dedendum and having at least one wedge-shaped cutting edge, wherein the cutting edge extends substantially perpendicular to the main cutting direction and roughly parallel to the longitudinal axis of the dedendum, at least one reaming element located laterally on the dedendum, the at least one reaming, element having a pin-type cutting edge and being configured for widening the working cross-section of the main cutting element, wherein with reference to the main cutting direction, the at least one reaming element projects laterally over the main cutting element and over the dedendum, and at least one further cutting element located laterally on the dedendum, on the same side as the at least one reaming element, and below the at least one reaming element, when seen in the advance direction of the dedendum, the at least one further cutting element having a pin-type cutting edge;

wherein the at least one main cutting element is arranged in a leading manner relative to the at least one reaming element in the main cutting direction on the dedendum, and wherein the main cutting element has a width, when seen at right angles to the main cutting direction, that unilaterally projects laterally over the dedendum on the side where the at least one reaming element and the at least one further cutting element are located.

11. Cutting tooth according to claim 10, wherein on the side remote from the at least one reaming element, the main cutting element, terminates flush with the flank of the underlying dedendum.

* * * * *